US011324086B2

(12) United States Patent
Yang

(10) Patent No.: US 11,324,086 B2
(45) Date of Patent: May 3, 2022

(54) SELF-ADAPTIVE DIMMING DRIVING SYSTEM

(71) Applicant: iDESYN Semiconductor Corp., Zhubei (TW)

(72) Inventor: Shih-Hsueh Yang, Zhubei (TW)

(73) Assignee: IDESYN SEMICONDUCTOR CORP., Zhubei (TW)

( * ) Notice: Subject to any disclaimer, the term of this patent is extended or adjusted under 35 U.S.C. 154(b) by 232 days.

(21) Appl. No.: 16/854,570

(22) Filed: Apr. 21, 2020

(65) Prior Publication Data

US 2020/0359475 A1 Nov. 12, 2020

(30) Foreign Application Priority Data

May 7, 2019 (TW) ..... 108115775

(51) Int. Cl.
*H05B 45/14* (2020.01)
*H05B 45/36* (2020.01)
*H05B 45/325* (2020.01)

(52) U.S. Cl.
CPC ..... *H05B 45/14* (2020.01); *H05B 45/325* (2020.01); *H05B 45/36* (2020.01)

(58) Field of Classification Search
CPC ..... H05B 45/14; H05B 45/36; H05B 45/325
See application file for complete search history.

(56) References Cited

U.S. PATENT DOCUMENTS 10,531,532 B1 * 1/2020 Fang ..... G05F 1/12
2012/0286694 A1 * 11/2012 Elder ..... H05B 45/397 315/287

FOREIGN PATENT DOCUMENTS

WO WO-2009009573 A2 * 1/2009 ..... H05B 45/18
WO WO-2019096626 A1 * 5/2019 ..... H05B 45/375

* cited by examiner

*Primary Examiner* — Alexander H Taningco
*Assistant Examiner* — Pedro C Fernandez
(74) *Attorney, Agent, or Firm* — Muncy, Geissler, Olds & Lowe, P.C.

(57) ABSTRACT

The present invention provides a self-adaptive dimming driving system, configured to work with a light-emitting diode (LED) power port, the self-adaptive dimming driving system comprising: a driving circuit, a forward bias voltage detection circuit, and a controller. The driving circuit is connected to the LED power port. The forward bias voltage detection circuit is connected between the LED power port and the driving circuit, Wherein the forward bias voltage detection circuit comprises a test current output module and a voltage feedback module, the test current output module is configured to output a test current to the LED power port, and the voltage feedback module is configured to output a detection signal according to a voltage parameter of the LED power port. The controller receives the detection signal, obtains a barrier potential parameter of an LED lamp according to the detection signal, and switches a power output mode of the driving circuit according to the barrier potential parameter.

11 Claims, 3 Drawing Sheets

SELF-ADAPTIVE DIMMING DRIVING SYSTEM

BACKGROUND OF THE INVENTION

1. Technical Field

The present invention relates to a dimming driving system. More particularly, the invention relates to a lamp driving system that can adjust its output power automatically in adaptation to the type of the lamp to be driven.

2. Description of Related Art

With the advancement of technology, the breakthroughs in white LEDs have resulted in the gradual replacement of the conventional lightbulbs and mercury-based light tubes by LEDs, which advantageously feature not only lower power consumption, but also longer service lives, higher efficiency, and less susceptibility to breakage than the traditional light sources. LED lamps, e.g., LED light tubes, are different from their conventional counterparts, e.g., fluorescent light tubes, in that, while a fluorescent light tube requires a stabilizer mounted in the lamp base in order to convert mains electricity into high-frequency alternating current (AC) for driving the fluorescent light tube, an LED light tube is designed to be driven by a direct-current (DC) power source instead and hence requires a power converter for converting mains electricity into DC power for driving the LED light tube, wherein the power converter may be built into the LED light tube or provided in the lamp base of the LED light tube. An LED lamp, therefore, allows its output power, and consequently brightness, to be freely adjusted (i.e., to be dimmed as desired), which is an obvious advantage over the traditional lightbulbs, mercury-based light tubes, and other fixed-power lighting devices in general lighting applications.

Current LED lamp standards cater only for the requirements of mains electricity, and this explains why most of the LED lamps (e.g., LED lightbulbs) come with an adapter and a driver. When such an LED lamp is damaged or reaches the end of its service life, the adapter and the driver of the LED lamp cannot but be discarded along with the LED lamp, which constitutes a wasteful use of resources. In view of this, some LED lamp base manufacturers have integrated the adapter and driver of an LED lamp into the lamp base so that, when the service life of the lightbulb or light plate mounted on the lamp base expires, all that needs to be replaced is the lightbulb or light plate. Nevertheless, the lack of an established limitation on the number or driving power of the LED light bulbs or light beads that can be mounted on a lamp base hinders interchangeability between the light bulbs or light plates of different brands, or even of different models of the same brand, causing inconvenience in use.

BRIEF SUMMARY OF THE INVENTION

The primary objective of the present invention is to provide a self-adaptive dimming driving system, configured to work with a light-emitting diode (LED) power port, the self-adaptive dimming driving system comprising: a driving circuit, a forward bias voltage detection circuit, and a controller. The driving circuit is connected to the LED power port. The forward bias voltage detection circuit is connected between the LED power port and the driving circuit, wherein the forward bias voltage detection circuit comprises a test current output module and a voltage feedback module, the test current output module is configured to output a test current to the LED power port, and the voltage feedback module is configured to output a detection signal according to a voltage parameter of the LED power port. The controller receives the detection signal, obtains a barrier potential parameter of an LED lamp according to the detection signal, and switches a power output mode of the driving circuit according to the barrier potential parameter.

Comparing to the conventional techniques, the present invention has the following advantages:

The present invention enables an LED lamp driving system to switch its output power automatically in adaptation to the LED lamp in use (e.g., an LED lightbulb or light plate). The invention contributes to the universal usability of LED lamps, is effective in reducing wasteful use of resources, and enhances convenience of use.

DETAILED DESCRIPTION OF THE INVENTION

The details and technical solution of the present invention are hereunder described with reference to accompanying drawings. For illustrative sake, the accompanying drawings are not drawn to scale. The accompanying drawings and the scale thereof are not restrictive of the present invention.

A preferred embodiment of the present invention is described below. Please refer to FIG. 1 and FIG. 2 respectively for a block diagram and a circuit diagram of a self adaptive dimming driving system according to the invention.

Figure 1:
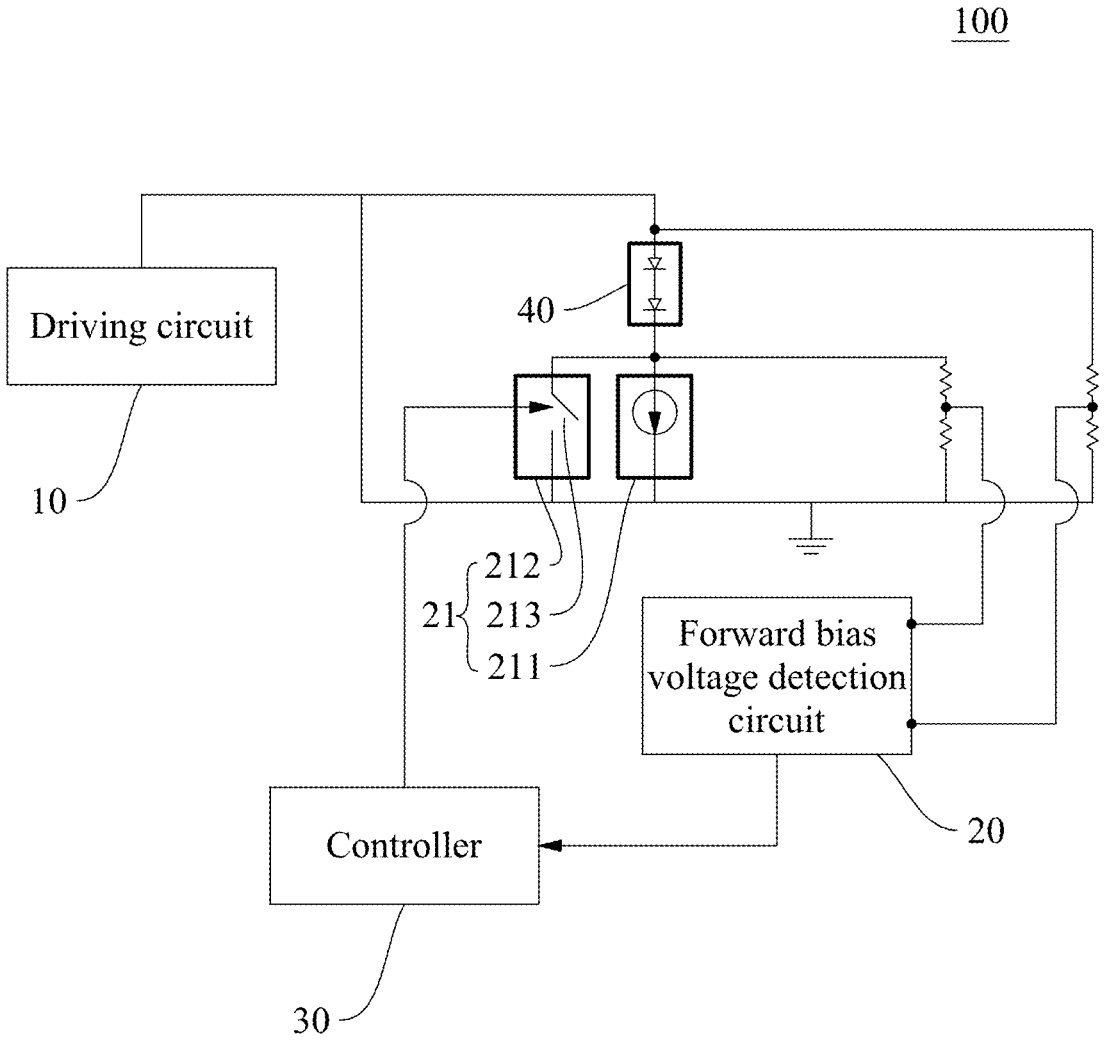
FIG. 1 is a block diagram of a self-adaptive dimming driving system according to the present invention.
Figure 2:
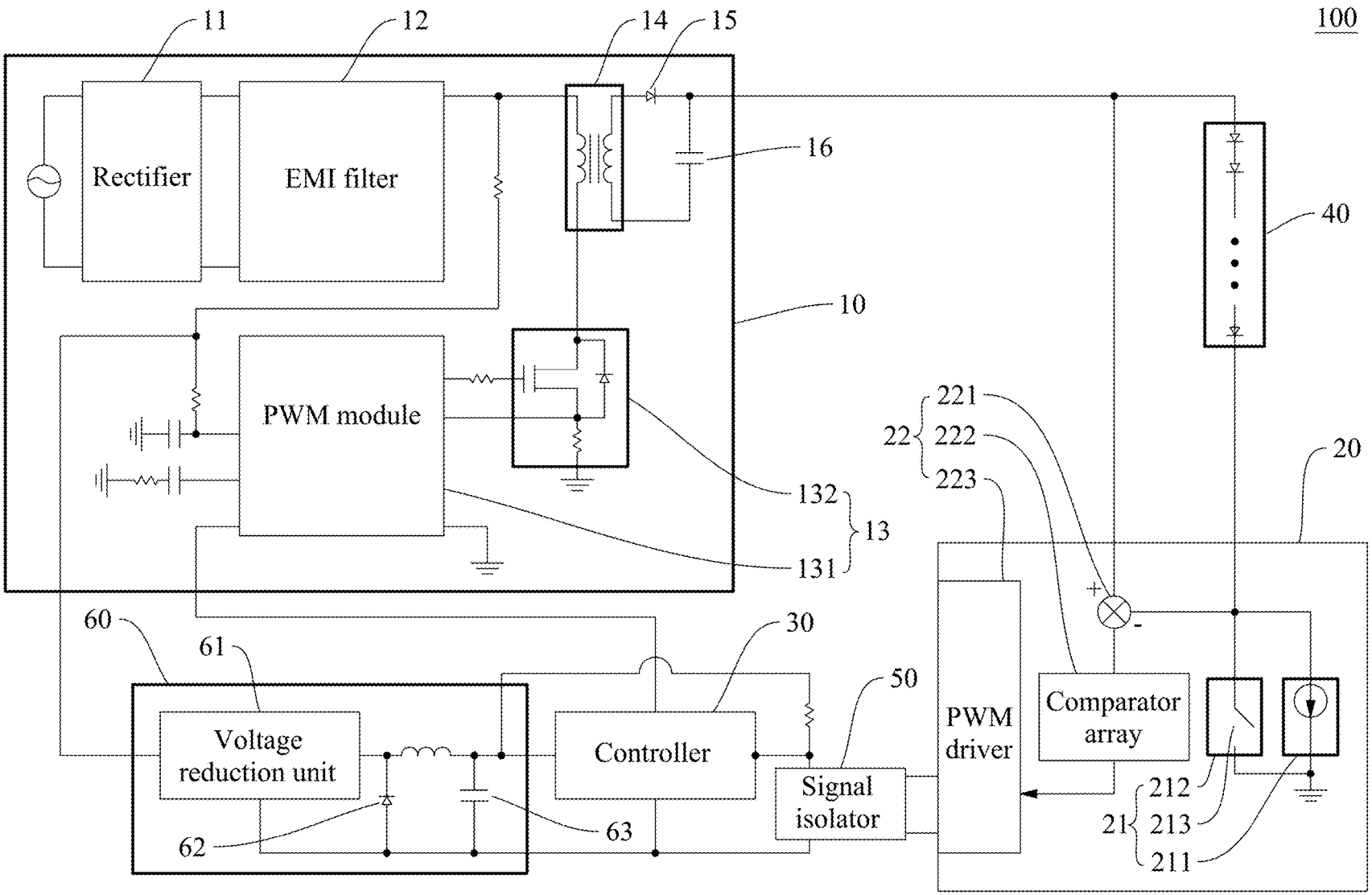
FIG. 2 is a circuit diagram of a self-adaptive dimming driving system according to the present invention.

The embodiment shown in FIG. 1 and FIG. 2 discloses a driving system 100 configured for self-adaptive dimming and for use with any type of LED light sources. The invention is applicable to indoor lighting, outdoor lighting, portable lamps, medical lamps, industrial lamps, and so forth.

The self-adaptive dimming driving system 100 can automatically adapt to an LED lamp by identifying the type and required operating voltage of the LED lamp and switching to a power output mode suitable for the LED lamp. The self-adaptive dimming driving system 100 essentially includes a driving circuit 10, a forward bias voltage detection circuit 20, and a controller 30.

The driving circuit 10 is connected to an LED power port 40 in order to provide the LED power port 40 with the required operating power. In one embodiment, the driving circuit 10 includes a rectifier 11, an electromagnetic interference (EMI) filter 12 provided at the rear end of the rectifier 11, and a power modulator 13 connected to the output of the EMI filter L. The rectifier 11 is configured to convert the input power from AC to DC. The EMI filter 12 is configured to suppress electromagnetic interference, transmit DC power to the rear-end device without power attenuation, and protect the rear-end device by minimizing the EMI signal transmitted to the rear-end device along with the DC power. The power modulator 13 is connected to the controller 30 and is configured to change its own power output mode according to the output signal of the controller 30. The power modulator 13 includes a pulse width modulation (PWM) module 131 connected to the controller 30 and a field-effect transistor 132 provided at the rear end of the PWM module 131. The field-effect transistor 132 is connected to the output of the EMI filter 12 and is turned on or off according to the output of the PWM module 131 in order for the output power of the EMI filter 12 to be controlled by the duty cycle of the output of the PWM module 131.

To isolate the front-end power circuit from the rear-end LED circuit, the driving circuit 10 further includes an isolation transformer module 14 provided at the rear end of the EMI filter 12, lest electric current be input directly from the power supply end (e.g., mains electricity) to the LED power port 40. In addition, the rear end of the isolation transformer module 14 is provided with a rectifier unit 15 and a filter unit 16 at the rear end of the rectifier unit 15, in order to rectify and filter the voltage to be output to the LED power port 40. The filter unit 16 serves mainly to filter the rectified DC power and thereby remove noise (e.g., ripples) from the DC power. The driving circuit 10 in the present invention may include any selected ones or combination of the foregoing devices, and the invention has no limitation on such selection or combination.

The forward bias voltage detection circuit 20, whose two ends are connected to the LED power port 40 and the controller 30 respectively, is configured to receive the voltage fed back from the LED power port 40, convert the voltage into a detection signal, and provide the detection signal to the controller 30. The forward bias voltage detection circuit 20 includes a test current output module 21 and a voltage feedback module 22. The test current output module 21 is electrically connected to the LED power port 40 in order to output a test current to the LED power port 40 and thus form a testing circuit together with the LED power port 40. The voltage feedback module 22 is configured to output a detection signal to the controller 30 according to a voltage parameter of the LED power port 40. The test current is larger than the minimum turn-on current of the LED lamp connected to the LED power port 40, in order for the voltage applied to the LED lamp to at least exceed the barrier potential. To run the test without turning on the LED lamp, however, the test current should be as small as possible (e.g., smaller than 5 μA).

In a feasible embodiment, the test current output module 21 includes a test current circuit 211 and a bypass circuit 212. The bypass circuit 212 includes a switch unit 213 connected to the controller 30. The switch unit 213 is turned on or off according to the instruction output from the controller 30, and the controller 30's decision to turn on or off the switch unit 213 is based on the voltage parameter received from the voltage feedback module 22. As an LED turned on by a very small current has very small equivalent internal resistance, the voltage fed back from the two ends of the LED lamp when the LED lamp is turned on by the test current will approach the barrier potential of the LED lamp. It is worth noting that although the test current circuit 211 and the bypass circuit 212 in this embodiment are controlled by two separate switches respectively (which two switches work in two opposite directions respectively), the test current value is so small that it is feasible to have only the switch unit 213 in the bypass circuit 212 while neglecting the test current.

The voltage feedback module 22 includes a subtractor 221, a comparator array 222, and a PWM driver 223. The subtractor 221 is connected to both ends of the LED power port 40 in order to obtain the voltage across the two ends of the LED power port 40 and then calculate the voltage difference between the two ends by subtracting the voltage at one end from the voltage at the other end. The comparator array 222 includes a plurality of comparators that are preset with different voltage values respectively. The comparator array 222 compares the voltage across the two ends of the LED power port 40 with the preset voltage values and outputs the comparison result to the PWM driver 223. The PWM driver 223, in turn, outputs a detection signal to the controller 30 according to the comparison result.

The controller 30 is connected to the driving circuit 10 and the forward bias voltage detection circuit 20. For example, the controller 30 may be a central processing unit, a programmable general-purpose or application-specific microprocessor, a digital signal processor (DSP), a programmable controller, an application-specific integrated circuit (ASIC), a radio-frequency system-on-chip (RF-SoC), other similar devices, or a combination of the above; the present invention has no limitation in this regard. The controller 30 may be configured to work with a storage unit, wherein the storage unit stores, for example, parameters, lookup tables, failure records, and so on. The storage unit may be, but is not limited to, an electrically erasable programmable read-only memory (EEPROM).

The controller 30 receives the detection signal, obtains a barrier potential parameter of the LED lamp according to the detection signal, and switches the power output mode of the driving circuit 10 according to the barrier potential parameter.

In a feasible embodiment, a signal isolator 50 is provided between the feedback output end of the forward bias voltage detection circuit 20 and the controller 30 to prevent noise that may otherwise result from interference between the controller 30 and the LED power port 40. In one embodiment, the signal isolator 50 is an optical coupler in which the light emitter and the corresponding light receiver relay the detection signal from the forward bias voltage detection circuit 20 to the controller 30 and thereby isolate the controller 30 from the circuit where the LED power port 40 is provided.

To supply the controller 30 with the necessary electricity, an adapter 60 is provided between the driving circuit 10 and the controller 30 to convert the output of the driving circuit 10 into the driving voltage and power needed by the controller 30. The adapter 60 includes a voltage reduction unit 61, a rectifier unit 62 provided at the rear end of the voltage reduction unit 61, and a filter unit 63 provided at the rear end of the rectifier unit 62.

Figure 3:
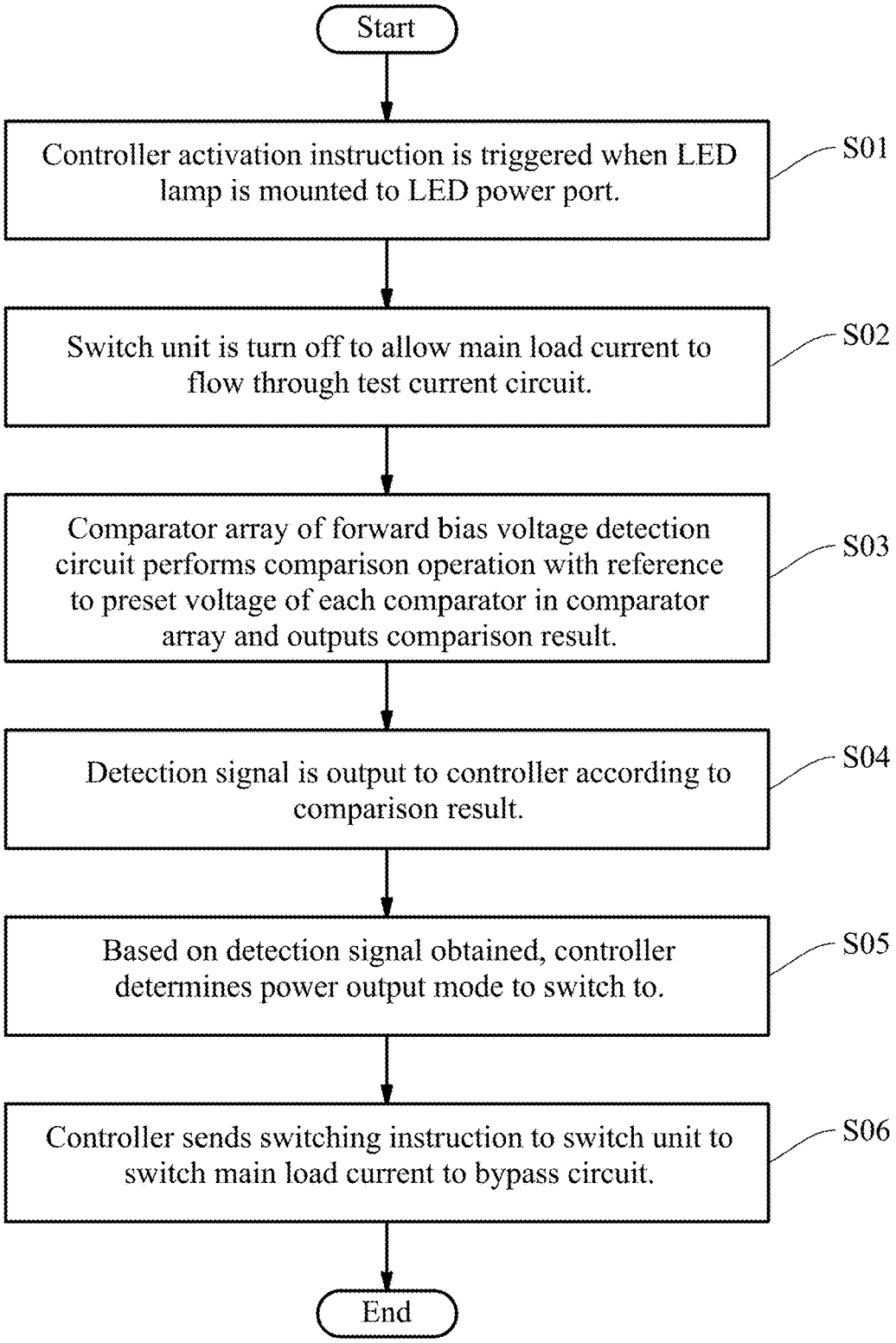
FIG. 3 is a control flowchart of a self-adaptive dimming driving system according to the present invention.

The operation process of the disclosed self-adaptive dimming driving system is described below with reference to FIG. 3, which is a control flowchart of the driving system.

To begin with, an activation instruction for activating the controller 30 is triggered by mounting the LED lamp to the LED power port 40 (step S01). The activation instruction may be triggered through a micro switch mounted on the lamp base or be controlled by a program in the controller 30. For example, the activation instruction may be triggered by a change in the voltage across the two ends of the LED power port 40 or by communication with a chip built in the LED lamp; the present invention has no limitation in this regard.

Once activated, the controller 30 outputs a first switching instruction to the switch unit 213 to turn off the switch unit 213 (i.e., to turn the switch unit 213 into an open circuit). As a result, the main load current flows through the test current circuit 211, and the test current of the test current circuit 211 flows through the LED power port 40 in order for the LED lamp connected to the LED power port 40 to have a voltage at least exceeding the barrier potential (step S02).

After the completion of step S02, the comparator array 222 of the forward bias voltage detection circuit 20 performs a comparison operation with reference to the preset voltage of each comparator in the comparator array 222 and outputs the comparison result to the PWM driver 223 (step S03). Thus, the interval to which the voltage across the two ends of the LED lamp belongs is determined. Following that, the PWM driver 223 outputs a detection signal to the controller 30 according to the comparison result (step S04). It should be pointed out that the detection signal is not necessarily a precise voltage value; it may be any parameter that is highly positively correlated to the barrier potential.

The forward bias voltage detection circuit 20, whose two ends are connected to the LED power port 40 and the controller 30 respectively, is configured to receive the voltage fed back from the LED power port 40, convert the voltage into a detection signal, and provide the detection signal to the controller 30. The forward bias voltage detection circuit 20 includes a test current output module 21 and a voltage feedback module. The test current output module 21 is electrically connected to the LED power port 40 in order to output a test current to the LED power port 40 and thus form a test circuit together with the LED power port 40. The voltage feedback module 22 is configured to output a detection signal to the controller 30 according to a voltage parameter of the LED power port 40. The test current is larger than the minimum turn-on current of the LED lamp connected to the LED power port 40, in order for the voltage applied to the LED lamp to at least exceed the barrier potential. To protect the LED lamp from damage, however, the test current should be as small as possible (e.g., 3 μA~5 μA).

After obtaining the detection signal, the controller 30 determines the power output mode to switch to based on the detection signal (step S05). Once the power output mode is determined, the controller 30 turns on the LED lamp by sending a second switching instruction to the switch unit 213 to switch the main load current to the bypass circuit 212, and by controlling the driving circuit 10 according to the power output mode determined (step S06).

In summary of the above, the present invention enables an LED lamp driving system to switch its output power automatically in adaptation to the LED lamp in use (e.g., an LED lightbulb or light plate). The invention contributes to the universal usability of LED lamps, is effective in reducing wasteful use of resources, and enhances convenience of use.

The above is the detailed description of the present invention. However, the above is merely the preferred embodiment of the present invention and cannot be the limitation to the implement scope of the invention, which means the variation and modification according to the present invention may still fall into the scope of the invention.

What is claimed is:

1. A self-adaptive dimming driving system, configured to work with a light-emitting diode (LED) power port, the self-adaptive dimming driving system comprising:

a driving circuit connected to the LED power port;

a forward bias voltage detection circuit connected between the LED power port and the driving circuit, wherein the forward bias voltage detection circuit comprises a test current output module and a voltage feedback module, the test current output module is configured to output a test current to the LED power port, and the voltage feedback module is configured to output a detection signal according to a voltage parameter of the LED power port; and a controller for receiving the detection signal, obtaining a barrier potential parameter of an LED lamp according to the detection signal, and switching a power output mode of the driving circuit according to the barrier potential parameter.

2. The self-adaptive dimming driving system of claim 1, wherein the test current output module includes a test current circuit and a bypass circuit, wherein the bypass circuit includes a switch unit connected to the controller, and the switch unit is turned on or off according to an instruction output from the controller.

3. The self-adaptive dimming driving system of claim 2, wherein the controller's decision to turn on or off the switch unit is based on a voltage parameter received from the voltage feedback module.

4. The self-adaptive dimming driving system of claim 1, wherein the voltage feedback module includes a subtractor, a comparator array, and a pulse width modulation (PWM) driver, wherein the subtractor is connected to both ends of the LED power port in order to obtain a voltage across the two ends of the LED power port; the comparator array includes a plurality of comparators that are preset with different voltage values respectively, and the comparator array compares the voltage across the two ends of the LED power port with the preset voltage values and outputs a comparison result to the PWM driver; and the PWM driver, in turn, outputs a detection signal to the controller according to the comparison result.

5. The self-adaptive dimming driving system of claim 1, wherein a signal isolator is provided between the forward bias voltage detection circuit and the controller.

6. The self-adaptive dimming driving system of claim 1, wherein the forward bias voltage detection circuit is directly connected to the controller.

7. The self-adaptive dimming driving system of claim 1, wherein an adapter is provided between the driving circuit and the controller to convert an output of the driving circuit into a driving power needed by the controller.

8. The self-adaptive dimming driving system of claim 7, wherein the adapter includes a voltage reduction unit, a rectifier unit provided at a rear end of the voltage reduction unit, and a filter unit provided at a rear end of the rectifier unit.

9. The self-adaptive dimming driving system of claim 1, wherein the driving circuit includes a rectifier, an electromagnetic interference (EMI) filter provided at a rear end of the rectifier, and a power modulator connected to an output of the EMI filter, wherein the power modulator is connected to the controller and is configured to change its own power output mode according to an output signal of the controller.

10. The self-adaptive dimming driving system of claim 9, wherein the power modulator includes a PWM module connected to the controller and a field-effect transistor provided at a rear end of the PWM module, wherein the field-effect transistor is connected to the output of the EMI filter and is turned on or off according to an output of the PWM module in order for an output power of the EMI filter to be controlled by a duty cycle of the output of the PWM module.

11. The self-adaptive dimming driving system of claim 9, wherein the driving circuit further includes an isolation transformer module provided at a rear end of the EMI filter, a rectifier unit provided at a rear end of the isolation transformer module, and a filter unit provided at a rear end of the rectifier unit, in order to rectify and filter a voltage to be output to the LED power port.

* * * * *